US005607160A

United States Patent [19]

Stevens et al.

[11] Patent Number: 5,607,160

[45] Date of Patent: Mar. 4, 1997

[54] THREE TALENT BOARDGAME

[76] Inventors: Arthur J. Stevens; Linda T. Stevens, both of 8783 Donnybrook Dr., Boise, Id. 83709

[21] Appl. No.: 585,115

[22] Filed: Jan. 11, 1996

[51] Int. Cl.[6] ..... A63F 3/00

[52] U.S. Cl. ..... 273/249

[58] Field of Search ..... 273/236, 242, 273/243, 248, 249

[56] References Cited

U.S. PATENT DOCUMENTS

| | | | |
|---|---|---|---|
| 4,216,594 | 8/1980 | Farley et al. | 273/243 X |
| 4,557,485 | 12/1985 | Lardon | 273/249 X |
| 4,934,709 | 6/1990 | Peterson | 273/249 |
| 5,092,606 | 3/1992 | Miller | 273/249 |
| 5,152,535 | 10/1992 | Roberts | 273/249 |
| 5,224,862 | 7/1993 | Sullivan | 273/243 X |
| 5,377,991 | 1/1995 | Olsen | 273/249 |

*Primary Examiner*—William E. Stoll

[57] ABSTRACT

The present invention is directed toward an educational and entertaining game that challenges the players knowledge, artistic and theatrical talents. The game is played by rolling a die and moving a game piece the appropriate number of spaces. The object of the game is to move completely around the pathway on the gameboard before the opposing teams. The pathway contains letters designating which category of play the team must perform. The three categories are Q-Question, D-Draw, and A-Act. Playing cards are included which contain the various questions, draw and act words to perform. Answers to the questions, as well as the reference to where in the Bible one can find the answer, are provided on the playing cards. Additionally, the gameboard has some spaces designated as open-play spaces in which the opposing teams may attempt to correctly solve the category first in order to discontinue the playing teams turn and advance around the playingboard. A team's play continues until they are unsuccessful at correctly answering the category within the allotted time or until they have successfully answered three consecutive categories. The pathway of spaces are three intersecting arcs that, when followed, return to the original Alpha/Omega space. The three categories of the game are presented to invoke all the players' talents and provide competitiveness between persons with different talents, while incorporating learning, fun and interaction.

16 Claims, 5 Drawing Sheets

Figure 2A

Trinity

Q: What answer does Jesus give to the Pharisees that ask, "Why does he (Jesus) eat with tax collectors and sinners."
a: "I have not come to call the righteous, but the sinners."
r: Mark 2:16-17
D: Ear
A: Waterfall, Chair, Thunder 1

12 13

15 Q: How old was Abram when his name was changed to Abraham?

16 a: 99 years old 11 r: Gen 17:1-5
18 D: Ox
19 A: Horse, Arrow, Bride 2

Q: Paul talks about waiting, "for the blessed hope...". What is the blessed hope?

a: The appearing of Jesus Christ r: Titus 2:13
D: Wineskin
A: Wave, Untie, Javelin 3

Figure 2B

Q: What did God change Jacob's name to?

a: Israel r: Gen 35:9-10
D: Honeycomb
A: Mix, Dream, Farmer 4

Q: What book of the Bible do we get the expression, 'skin of my teeth'?

a: Book of Job r: Job 19:20
D: Foundation
A: Scribe, Stir, Passover 5

Q: Jesus tells us "Heaven and earth will pass away," but what will never pass away?

a: His words r: Mat 24:35
D: Firstfruit
A: Fisherman, Harpoon, Necklace 6

Q: Who walked on water besides Jesus?

a: Peter r: Mat 14:28-29
D: Hook
A: Shepherd, Hovering, Rebuild 7

12 13 15 16 11 18 19

THREE TALENT BOARDGAME

BACKGROUND OF THE INVENTION

1. Field of the Invention

The present invention is directed toward a competitive game apparatus with three categories of talent; knowledge, artistic and theatrical, and more specifically to such game apparatus that allows a team to advance around a gameboard in pursuit of the finish by correctly performing the different categories.

2. Prior Art Statement

In the past, hundreds of boardgames have been created that use dice, have cards, and use playing pieces which move from space to space. In such traditional games the ability to move around the board is often based on knowledge or talent or luck. Although different games exist that have these characteristics, none exist that combine all the traits of the present invention, Trinity; Questions (knowledge), Drawing (artistic), and Acting (theatrical). Trivial Pursuit is a traditional boardgame in which movement around the board is based on answering questions, but does not incorporate either of the other traits of Trinity, acting and drawing. Another traditional boardgame is Pictionary where movement around the board is based on the artistic talent of drawing a specific word, but does not incorporate either of the other traits of Trinity, questions and acting. Yet another game is Guesstures in which the object of the game is based on the ability to act out a specific word, but does not incorporate either of the other traits of Trinity, questions and drawing.

Thus, although prior art does exist with similar methods of movement around a board, prior art does not combine the aspects found in Trinity; questions, drawing and acting. Accordingly, it is among the objects of the present invention to provide an educational, entertaining and challenging game apparatus that stimulates the various skills (questions, drawing, acting) into one game, while integrating a means of suspense as to which category will be performed next.

Furthermore, present art does not present the physical playing pattern of the present invention as is expressed in the following specifications.

BRIEF SUMMARY OF THE INVENTION

The present invention is directed toward an entertaining board game that encompasses and challenges players in three categories: questions, drawing and acting. After rolling the die to see which team plays first, play begins on the Alpha/Omega (Draw) space without advancing. A playing card is drawn by the playing team and the die is rolled. The Draw word selected from the playing card corresponds to the number of the roll. If a team rolls an eight they may select from any of the seven draw words on the playing card. The player then reads the designated word to him/herself and attempts to draw the word with the writing surface and writing utensil provided, without using numbers, letters or symbols. The other team members continue to attempt to identify the word within the allotted time, determined by the timer. A team's turn continues until they are unsuccessful at answering the category within the allotted time or until they have successfully answered three consecutive categories.

When a team is positioned on a Question space, one member of the team selects a playing card and reads the corresponding numbered question determined by the roll of the die, to the other team members. The other members confer amongst themselves and give one answer within the allotted time. When a team is positioned on a Draw space, one member of the team selects a playing card and reads the corresponding numbered draw word determined by the roll of the die, to him/herself, and draws the word without using numbers, letters or symbols. The other team members then attempt to correctly guess the word, within the allotted time. When a team is positioned on an Act space, one team member selects a playing card and reads the designated Act words determined by the roll of the die, to him/herself, and then acts out the words without the aid of sounds, words or sign language. The other team members then attempt to correctly guess the words, within the allotted time.

Some spaces are designated as Question or Draw "Open-Play" in which the other teams are allowed to try and correctly answer the category before the playing team. If this occurs, the playing team loses their turn; the team who correctly answered the category rolls the die and moves forward the corresponding number of spaces. Play then resumes in its original order. Some spaces are designated as Act "Open-Play" in which the other teams are allowed to try and correctly identify the words before the playing team. Each team shall advance one space for each correct word. If a team identifies all three correct words they are to roll the die and advance the corresponding number of spaces. The playing team retains their turn for one or more correct answers. The winning team is the team that first reaches the Alpha/Omega space and correctly answers the corresponding category.

Accordingly, it is the object of this invention to provide an entertaining and challenging game while combining the three categories of play of acting, drawing, and answering questions into a single game.

BRIEF DESCRIPTION OF THE DRAWINGS

In order to obtain a complete understanding of the nature and objects of the present invention, reference is made to the following drawings in which like parts are given numerals, and wherein:

FIG. 2A is a front plan view of a sample playing card;

FIG. 2B is the reverse angle of FIG. 2A showing a back plan view of a playing card;

DETAILED DESCRIPTION OF THE PREFERRED EMBODIMENT

Figure 1A:
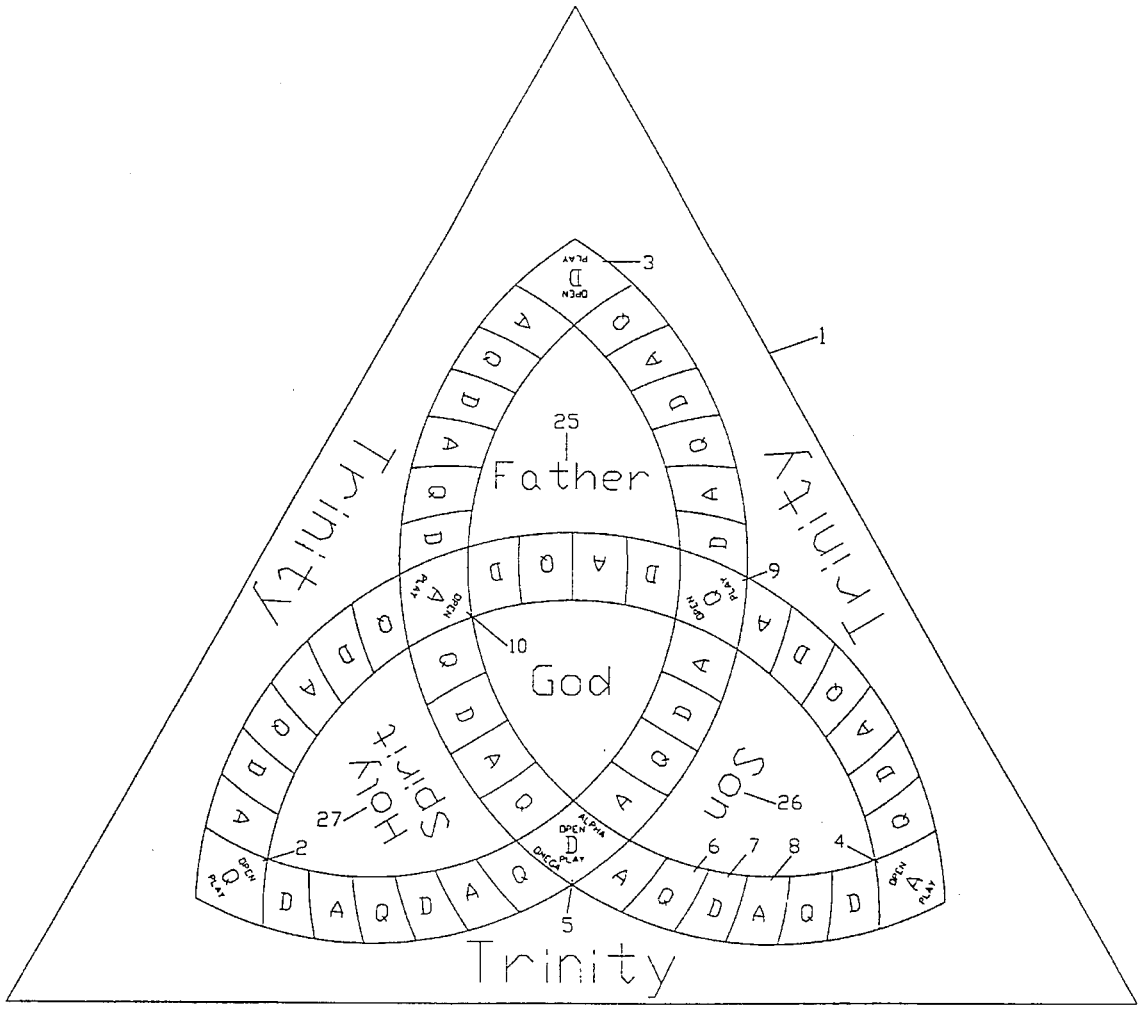
FIG. 1A is a plan view of the gameboard ready for play.

Before explaining in detail the present invention, it is to be understood that the invention is not limited in its application to the details illustrated in the accompanying drawings, since the invention is capable of other embodiments and of being practiced or carried out in various ways. Possible examples of other variations and/or versions are a different timer, a children's version, a secular version. Also, it is to be understood that the phraseology and terminology employed herein is for purpose of description and not limitation.

The present invention is, as mentioned, directed toward a game apparatus that provides a competitive, entertaining and educational medium. Furthermore, it is intended to incorporate three different aspects of talent; answering questions, drawing word pictures and interpreting them from other players, and acting out words and interpreting them from other players. It is intended to arouse and provoke all of these talents in the players as well as attract persons with these different talents to one game.

The logic of the gameboard and the rules of play are best described when referring to the drawings. Since all figures refer to components of the present invention, FIGS. 1 through 3 must be considered together as comprising one full preferred embodiment of the present invention.

Figure 1B:
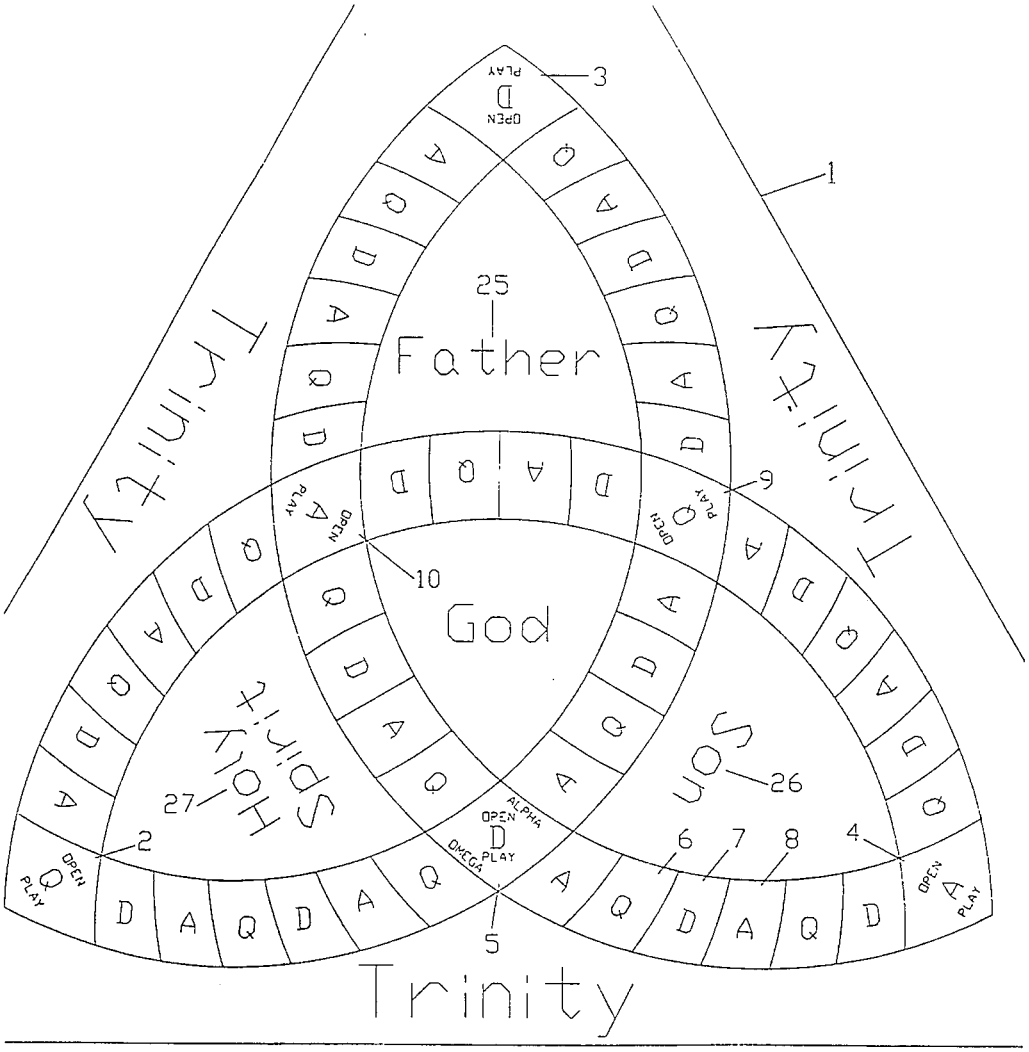
FIG. 1B is a exploded plan view of the playing path.
Figure 3:
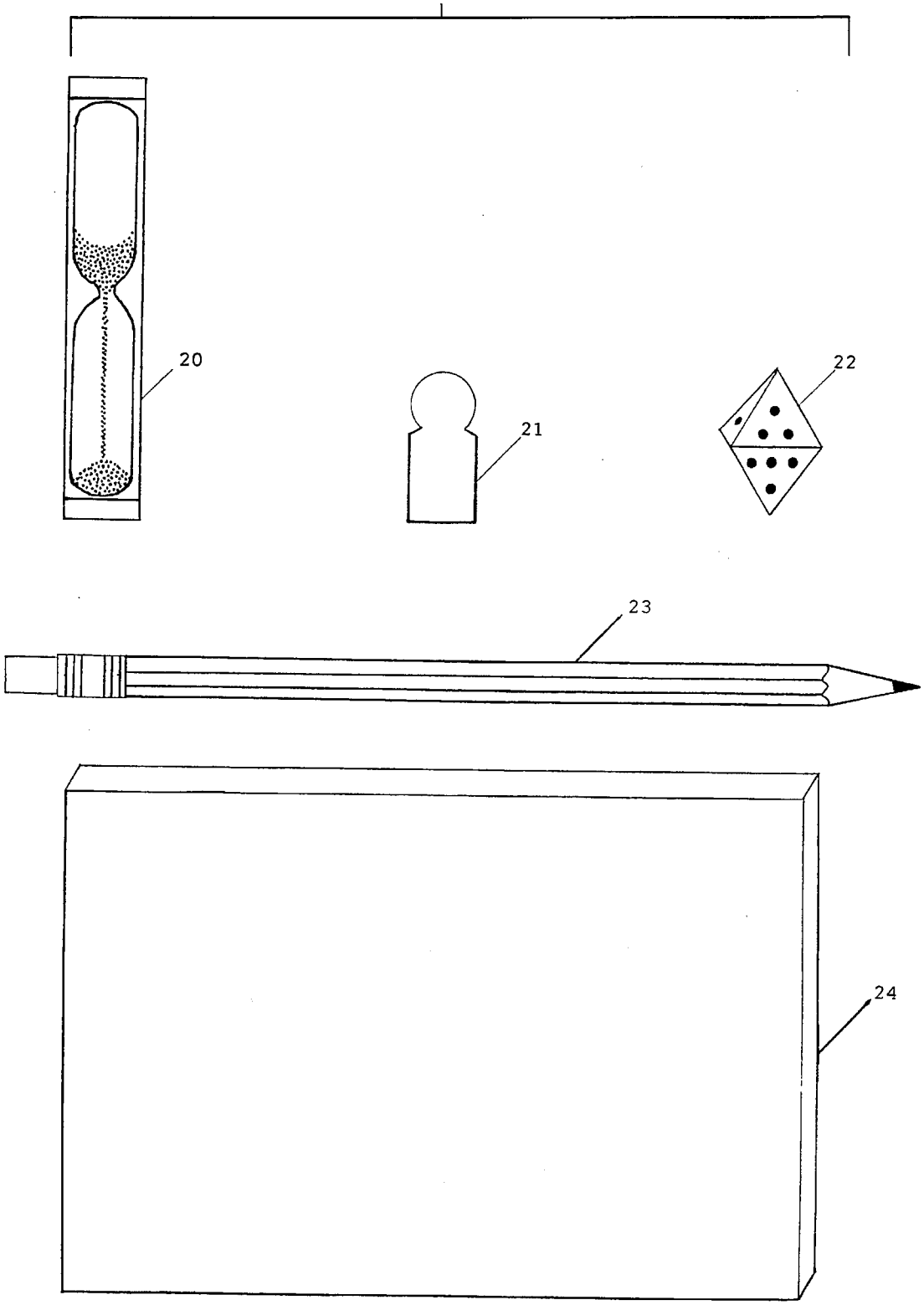
FIG. 3 is a drawing of the components, including the timer, playing piece, chance die, writing utensil and writing surface.

Referring to FIGS. 1 through 3, the gameboard 1 is ready for play in the following manner. Each team, comprising of two or more players, chooses a colored game piece 21 to represent their team and its position on the game board and places that piece on the "D" (Draw) space marked Alpha/Omega 5. Teams roll the die 22 to select who begins first. The team with the highest roll begins first.

MOVEMENT ALONG THE PATH

Movement around the board is counterclockwise, first circling "Father" 25, then "Son" 26, then "Holy Spirit" 27. Teams advance around the board by correctly answering a Question 15, or identifying a Draw 18 or Act 19 that their teammate has selected from the playing cards 12. A team's turn continues until they are unsuccessful at answering a category or until they have successfully answered three consecutive categories.

CARDS AND CATEGORIES

The category of Question, Draw or Act is determined by the space on which the playing team is currently positioned, while the selection of which Question 15, Draw 18 or Act 19 on the playing card 12 is determined by the roll of the die 22. If an eight is rolled, the playing team may choose from any of the seven choices on the playing card 12 within their category.

DRAW

If a team starts their turn on a "D" (Draw) space 7, a member of the playing team selects a playing card 12, rolls the die 22, and silently reads the corresponding numbered draw word 18. The playing time begins when a member from an opposing team says, "Go", and starts the timer 20. The individual is then allowed to draw the word using the writing surface 24 and writing utensil 23. The playing team, less the reader, has the allotted time to continue guessing the draw word 18, until identified. Upon successfully guessing the draw word 18, the team continues their turn by rolling the die 22, moving forward the corresponding number of spaces, and selecting the same corresponding numbered selection 13 on a new playing card 12.

The player is not allowed to draw numbers, letters or symbols (#,$,& . . . ). No acting, sounds or words are allowed either.

QUESTION

If a team starts their turn on a "Q" (Question) space 6, a member of the playing team selects a playing card 12, rolls the die 22, and reads the corresponding numbered question 15 aloud. A member from an opposing team then says, "Go", and starts the timer 20. The question 15 can be read again during the allotted time. The playing team, less the reader, has the allotted time to confer amongst themselves, and give one agreed upon answer. The reference 11 to where in the Bible one can find the answer is provided on the playing card 12. Upon successfully answering the question, the team continues their turn by rolling the die 22, moving forward the corresponding number of spaces, and selecting the same corresponding numbered selection 13 on a new playing card 12.

ACT

If a team starts their turn on an "A" (Act) space 8, a member of the playing team selects a playing card 12, rolls the die 22, and silently reads the three corresponding act words 19. The playing time begins when a member from an opposing team says, "Go", and starts the timer 20. The individual is then allowed to act out each word using any gestures, or available objects. The playing team, less the reader, has the allotted time to continue guessing the act words until each is identified. The actor may perform the words in any order. Upon successfully guessing one act word 19, the playing team advances one space and selects the first selection on a new playing card 12 in the new category of play. Upon successfully guessing two act words 19, the playing team advances two spaces and selects the second selection on a new playing card 12 in the new category of play. If the playing team identifies all three act words 19, they continue their turn by rolling the die 22, advancing the corresponding number of spaces, and selecting the same corresponding numbered selection 13 on a new playing card 12. No sounds or words may be used. There are no challenges on act words.

CHALLENGES

At the end of each team's turn, if the playing team is unable to successfully answer the category, the other team(s) may Challenge. If another team believes they know the answer 16 or 18 to the category, they may challenge the turn by saying, "Challenge", and giving their answer. If they are correct, they may roll the die 22 and move forward the corresponding number of spaces. If they are incorrect, the playing team will roll the die 22 and the challenging team will have to move back the corresponding number of spaces. The game will then resume in its original order.

If a challenge is made at the beginning of the game within the first seven spaces and the challenging team gives an incorrect answer, they will not be allowed to advance on their next successful turn.

If two or more teams challenge, they are to write down their answers and submit them to the playing team. Each team is dealt with the same as above on an individual basis.

If the playing team gives the correct answer 16 or 18 after their turn, before the opposing team(s) have a chance to challenge, the playing team must move back three spaces. If this occurs at the beginning of the game within the first three spaces they will not be allowed to advance on their next successful turn.

OPEN-PLAY

The three corner spaces and three intersecting spaces are Open-Play spaces 2,3,4,5,9,10. (The Alpha/Omega space 5 is not an Open-Play space when it is the start of the game.) If a team lands on a Question or Draw Open-Play space 2,3,5,9 one member of the playing team is to draw or ask the question and the session is open to all teams. If a member of an opposing team gives the correct answer 16 or 18 first, the team giving the correct answer 16 or 18 may roll the die 22 and advance the corresponding number of spaces. The playing team's turn is then over and play continues in its original order. If the playing team gives the correct answer 16 or 18 first, they may roll the die 22 and continue play.

If a team lands on an Act Open-Play space 4,10 one member of the playing team is to act out each word and the session is open to all teams. Each team may advance one space for every correct answer 19. If one team correctly identifies all three act words 19 they may roll the die 22 and advance the corresponding number of spaces. (If an opposing team is the one to guess all three act words the playing team's turn is over and play continues in its original order.) If the playing team gets one or more correct act words 19 their turn would be allowed to continue in the usual way. There is no challenge on an Open-Play space.

WINNING THE GAME

The winning team is the first team to move around the entire gameboard 1, land on the final Alpha/Omega space 5, and win the final play. Teams may advance to the final Alpha/Omega space 5 if they roll a number equal to or greater than the number of spaces they are from it. The final Alpha/Omega space 5 is considered Open-Play. If a member of the playing team is first to correctly identify the draw word they are the winners.

FINAL RULE

Each player on a team is to take turns acting, drawing, and asking questions. This should be done in a consistent order.

For play with just three people rotate the reader of the question, draw or act words after each play. Open-Play and Challenges do not apply.

CLAIMS

As can be seen, the present invention constitutes a significant advantage over the current state of technology.

As numerous additions, modifications and constructions can be performed within the scope of the invention, such scope is to be measured by the claims herein.

What is claimed:

1. A board game apparatus comprising:

(A) A plurality of distinguishable playing pieces representing teams;

(B) A timer for indicating the time a team has to respond;

(C) A plurality of playing cards, each said card having a plurality of questions with the answers and reference to the location of the answers in the Bible, a plurality of specific words for acting and a plurality of specific words for drawing;

(D) A continuous path atop a gameboard, comprising three intersecting arcs, when followed in a counterclockwise direction returns to the beginning of said path including;

(a) A plurality of question spaces, whereon a distinctive identifying indica is printed, corresponding to the category of Question, and indicating the category to be selected from the playing cards;

(b) A plurality of draw spaces, whereon a distinctive identifying indica is printed, corresponding to the category of Draw, and indicating the category to be selected from the playing cards;

(c) A plurality of act spaces, whereon a distinctive identifying indica is printed, corresponding to the category of Act, and indicating the category to be selected from the playing cards;

(d) A plurality of open-play spaces, whereon a distinctive identifying indica is printed, wherein answering said category of play is open to all teams;

(e) A single Alpha/Omega space, whereon a distinctive identifying indica is printed, indicating the start and finish of the path and game;

(E) A means for randomly selecting a number for:

(a) Corresponding movement of a team's playing piece along the path;

(b) Corresponding selection of the plurality of choices within the category of play upon a playing card;

(F) A writing surface to draw upon for the category of draw;

(G) A writing utensil to draw with for the category of draw.

2. The game apparatus of claim 1 wherein said means for randomly selecting a number is an eight sided die, rolled by the players.

3. The game apparatus of claim 1 wherein said playing cards have seven questions, answers and references to the location of the answer in the Bible, seven words designating the draw to be drawn, and seven groups of three words designating the acts to be performed.

4. The game apparatus of claim 3 wherein there is a combination of the three categories of play, namely questions, drawing, and acting all in one game.

5. The game apparatus of claim 4 wherein the object of the Question category is to correctly answer the question within the allotted time in order to advance around the playing board.

6. The game apparatus of claim 5 wherein the object of the Draw category is to draw the selected word in order for the playing team to guess the word within the allotted time, in order to advance around the playing board.

7. The game apparatus of claim 6 wherein the object of the Act category is to act the selected words in order for the playing team to guess the words within the allotted time, in order to advance around the playing board.

8. The game apparatus of claim 1 wherein the path is three intersecting arcs forming a continuous interlocking path containing; question, draw, act, open-play and start/finish space(s).

9. The game apparatus of claim 8 wherein the spaces with the indica for Question is the method of selection of said category.

10. The game apparatus of claim 9 wherein the spaces with the indica for Draw is the method of selection of said category.

11. The game apparatus of claim 10 wherein the spaces with the indica for Act is the method of selection of said category.

12. The game apparatus of claim 11 wherein the spaces indicated open-play are open to any team for play regardless of which team is on that space.

13. The game apparatus of claim 12 wherein the space indicated Alpha/Omega is the method to determine the start and finish of the path.

14. The game apparatus of claim 13 wherein two of the spaces of intersection on the path indicate both category of play and open-play spaces.

15. The game apparatus of claim 14 wherein one of the spaces of intersection on the path indicates category of play, open-play and start and finish.

16. The game apparatus of claim 15 wherein the three outer most spaces indicate both category of play and open-play.

* * * * *